US006443690B1

(12) United States Patent
Zabrecky et al.

(10) Patent No.: US 6,443,690 B1
(45) Date of Patent: Sep. 3, 2002

(54) STEAM COOLING SYSTEM FOR BALANCE PISTON OF A STEAM TURBINE AND ASSOCIATED METHODS

(75) Inventors: Joseph S. Zabrecky, Oviedo; Douglas R. Ulrich, Chuluota, both of FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/305,578

(22) Filed: May 5, 1999

(51) Int. Cl.[7] ..... F01B 23/00; F01D 3/00; F01D 25/08

(52) U.S. Cl. ..... 415/29; 415/107; 415/175

(58) Field of Search ..... 415/104, 105, 415/106, 107, 94, 95, 96, 102, 103, 26, 28, 29, 116, 117, 175

(56) References Cited

U.S. PATENT DOCUMENTS 3,614,255 A * 10/1971 Rooney ..... 415/107 X
3,895,689 A * 7/1975 Swearingen ..... 415/104 X
4,214,436 A * 7/1980 Romeyke et al. ..... 415/107 X
4,615,657 A * 10/1986 Kreitmeier ..... 415/104
4,864,810 A * 9/1989 Hines ..... 415/107 X
4,884,942 A * 12/1989 Pennink ..... 415/104
5,104,284 A * 4/1992 Hustak, Jr. et al. ..... 415/105
5,141,389 A * 8/1992 Bear et al. ..... 415/107 X
5,154,048 A * 10/1992 Ponziani et al. ..... 415/107 X
5,248,239 A * 9/1993 Andrews ..... 415/104
5,312,226 A * 5/1994 Miura et al. ..... 415/106
5,760,289 A * 6/1998 Skottegard ..... 415/104 X

* cited by examiner

*Primary Examiner*—John E. Ryznic

(57) ABSTRACT

A steam cooling system (30) and associated methods are provided which have a first high pressure (HP) steam turbine (12) having a straight through configuration, a second intermediate pressure (IP) steam turbine (16) having a straight through configuration positioned adjacent the first HP steam turbine (12), and a balance piston (40) positioned adjacent the inlet (17) of the second IP steam turbine (16) and between the second IP steam turbine (16) and the first HP steam turbine (12). A steam cooling conduit (32) is preferably positioned to have an inlet adjacent the first HP steam turbine (12) and an outlet adjacent the balance piston (40) for providing a steam cooling path therebetween. The system (10) also has a controller (31) positioned to control cooling steam pressure, a cooling steam control valve (35) connected to the conduit (32) and the controller (31), a first pressure sensor (33) in communication with the controller (31) and positioned adjacent the inlet (17) of the IP turbine (16) and downstream from the balance piston (40) for sensing inlet pressure to the second IP steam turbine (16), and a second pressure sensor (34) positioned in communication with the controller (31) in the conduit (32) upstream from the first pressure sensor (33) and the balance piston (40) and downstream from the cooling steam control valve (35) for sensing conduit cooling steam pressure so that the cooling steam control valve (35) operationally opens and closes to maintain the cooling steam conduit pressure at a predetermined level greater than the inlet pressure of the second IP turbine (16).

25 Claims, 4 Drawing Sheets

STEAM COOLING SYSTEM FOR BALANCE PISTON OF A STEAM TURBINE AND ASSOCIATED METHODS

FIELD OF THE INVENTION

This invention is related to the power generation industry and, more particularly, to the field of electrical power generators.

BACKGROUND OF THE INVENTION

In the power generation industry, steam turbines are often used to generate electrical power. The steam turbines often are positioned in a series of varying steam pressures so that a high pressure (HP) turbine, an intermediate pressure (IP) turbine, and a low pressure (LP) turbine are respectively positioned one after the other. With reaction blading, the reaction of steam causes the blades of the rotor to turn. The reaction blading provides a very high pressure drop and, accordingly, the thrust across the rotor is quite high. Accordingly, an imbalance can arise between the HP turbine and the IP turbine and/or the LP turbine.

Although a split flow turbine can be used in an attempt to reduce or eliminate the thrust for the IP and/or combined IP-LP turbines, split flow turbine designs can be expensive and complex. Combined IP-LP turbines with a split flow design also have a thermal efficiency loss associated with the redirecting of the steam from the exit of the IP section of blading to the inlet of the LP section of blading. Accordingly, for certain applications, an IP turbine and/or a combined IP-LP turbine with reaction blading and a straight through flow configuration is desirable.

Therefore, as an alternative, a balance piston can be positioned at the inlet to the IP and/or combined IP-LP turbines having a straight flow design in an attempt to thereby balance thrust. Even with such a balance piston, however, the turbine system can still have problems in that creep deformation of the balance piston can occur. For example, in a large diameter balance piston positioned in such a turbine system, a large tangential stress in the rotor material can arise at running or operational speeds and due to the location of the balance piston near a hot inlet of the IP turbine, creep deformation can also occur.

SUMMARY OF THE INVENTION

In view of the foregoing, the present invention provides a steam cooling system and associated methods for a balance piston of a steam turbine system which allows a straight flow through design for each of a series of turbines in the system and which significantly reduces potential damage to the balance piston. The present invention also advantageously provides a steam cooling system and associated methods having cooling steam routed between a HP turbine and an IP-LP turbine to reduce potential damage to the balance piston. The present invention also advantageously provides a steam cooling system and associated methods having a straight through design for each of a series of turbines to thereby reduce the costs and complexity for the turbine system. The present invention further advantageously provides a steam cooling system and methods which significantly reduces or eliminates the efficiency losses of redirecting the steam that is found in a split flow combined IP-LP design.

More particularly, the present invention provides a steam cooling system having a first high pressure (HP) steam turbine having a straight through configuration, a second intermediate pressure (IP) steam turbine having a straight through configuration positioned adjacent the first HP steam turbine, and a balance piston positioned adjacent the inlet of the second IP steam turbine and between the second IP steam turbine and the first HP steam turbine. A steam cooling conduit is preferably positioned to have an inlet adjacent the first HP turbine and an outlet adjacent the balance piston for providing a steam cooling path therebetween. The system also has steam pressure controlling means connected to the conduit for controlling cooling steam pressure during cooling steam flow between the first HP turbine and the second IP turbine so that the cooling steam conduit pressure is operationally maintained at a predetermined level greater than the inlet pressure of the second IP turbine.

The steam pressure controlling means preferably includes a controller positioned to control cooling steam pressure, a cooling steam control valve connected to the conduit and the controller, a first pressure sensor in communication with the controller and positioned adjacent the inlet of the IP turbine and downstream from the balance piston for sensing inlet pressure to the IP turbine, and a second pressure sensor positioned in communication with the controller in the conduit upstream from the first pressure sensor and the balance piston and downstream from the cooling steam control valve for sensing conduit cooling steam pressure so that the cooling steam control valve operationally opens and closes to maintain the cooling steam conduit pressure at a predetermined level greater than the inlet pressure of the second IP turbine.

The present invention also includes a method of steam cooling a turbine system. The method preferably includes positioning a balance piston between first and second steam turbines and adjacent the inlet of the second steam turbine, providing a steam cooling path between the first and second steam turbines and in communication with the balance piston, and controlling cooling steam pressure during cooling steam flow between the first and second steam turbines so that the cooling steam conduit pressure is operationally maintained at a predetermined level greater than the inlet pressure of the second steam turbine.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation if used indicate similar elements in alternative embodiments.

Figure 1:
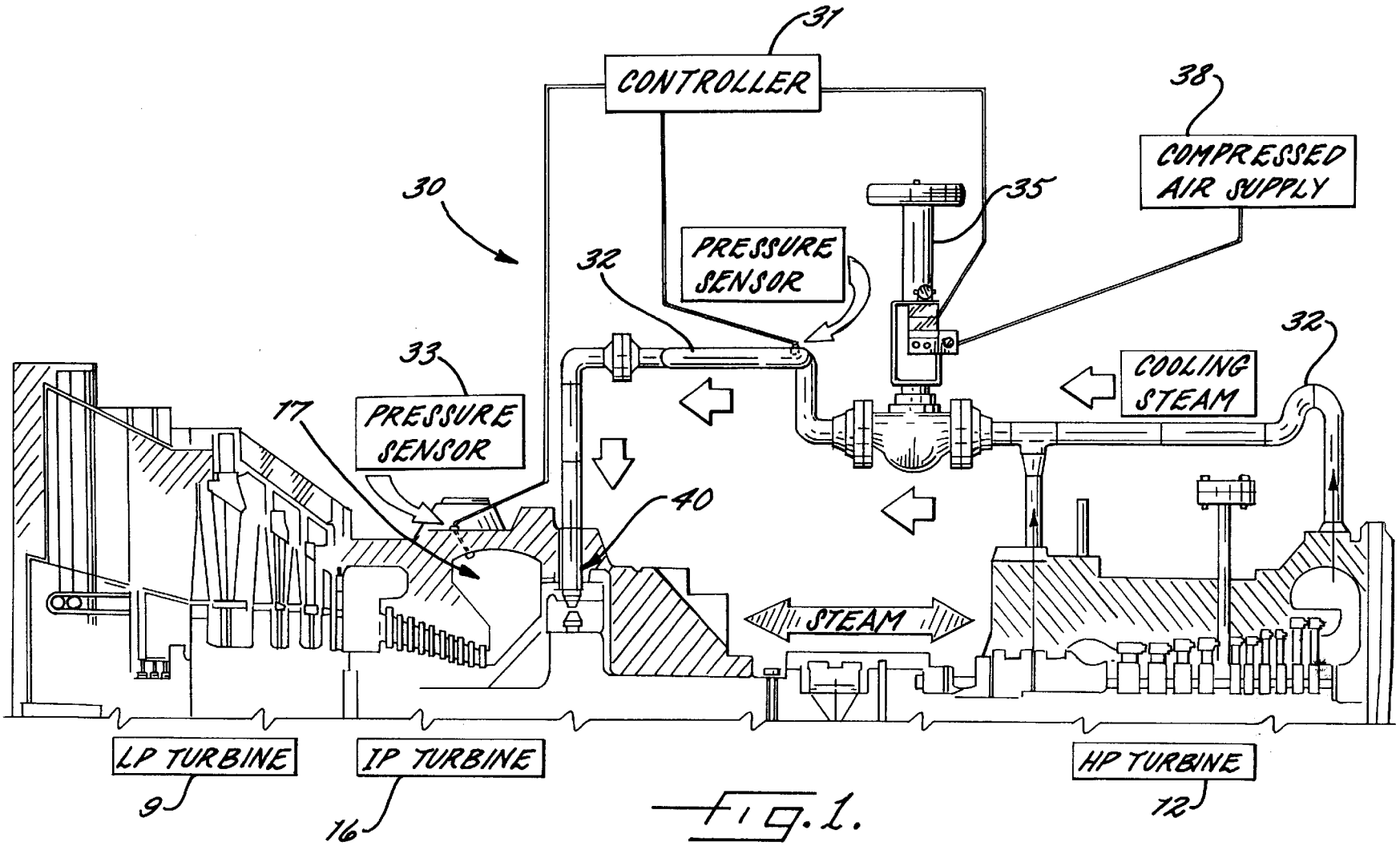
FIG. 1 is sectional side elevational view of a steam cooling system for a balance piston positioned in a series of turbines according to the present invention.
Figure 3:
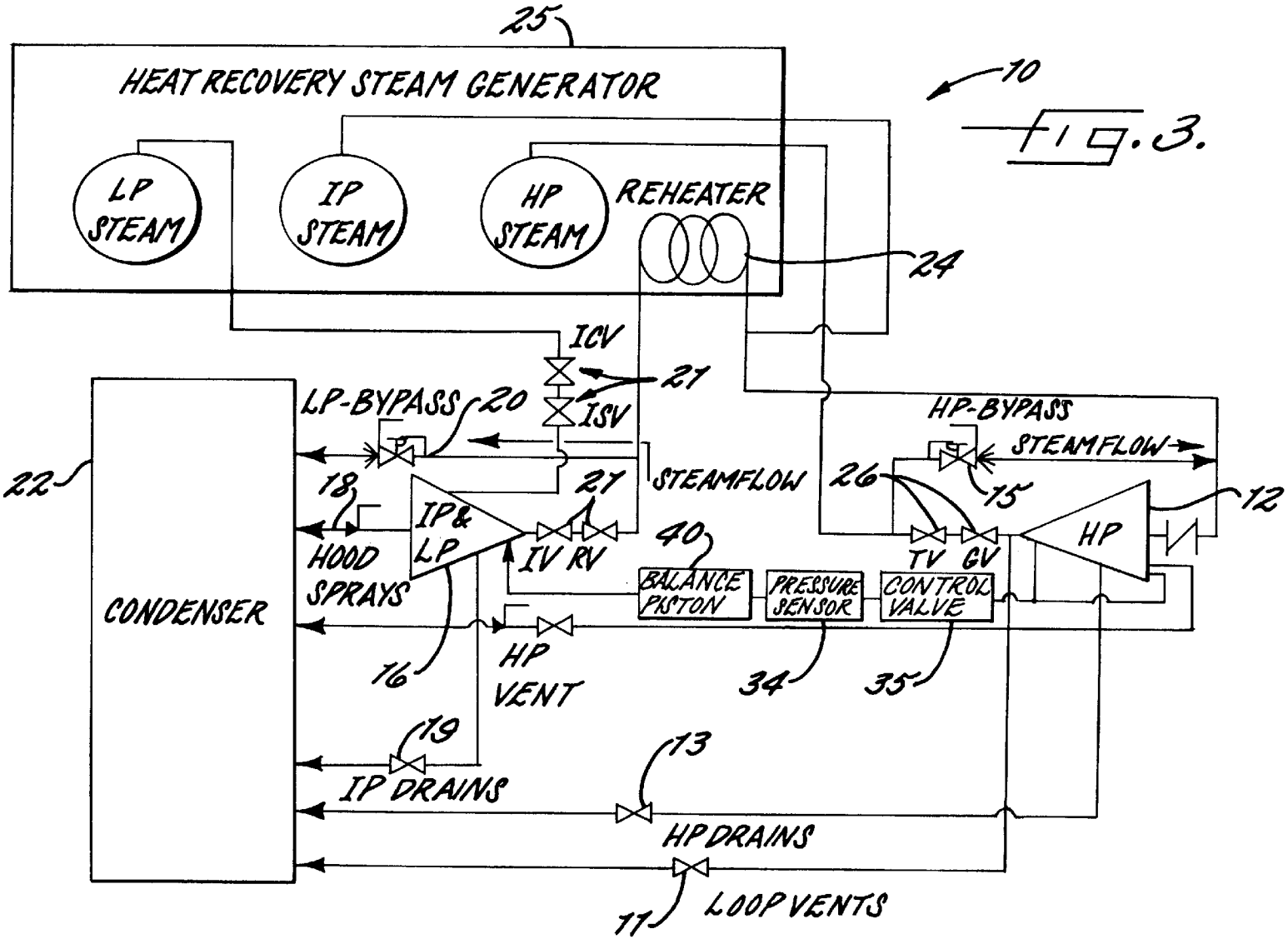
FIG. 3 is a schematic block diagram of a steam cooling system for a balance piston in a series of turbines according to the present invention.

FIGS. 1 and 3 illustrate a steam cooling system 30 for a balance piston 40, as understood by those skilled in the art, positioned between a first high pressure (HP) steam turbine 12 having a straight through configuration and a second intermediate pressure (IP) steam turbine 16 having a straight through configuration positioned adjacent the first HP steam turbine 12 of a steam turbine power generation system 10. A low pressure (LP) steam turbine 9 can also form part of the turbine system 10, e.g., downstream from the IP turbine or as part of the IP-LP turbine. The balance piston 40 is positioned adjacent the rotor inlet area 17 of the second IP steam turbine 16 and between the second IP steam turbine 16 and the first HP steam turbine 12.

As perhaps best illustrated in FIG. 3, the steam turbine power generation system 10 can have a plurality of conduits or piping routes for the steam and a plurality of valves to assist in managing the system 10. As shown, for example, the HP steam turbine 12 can include loop vents 11, HP drains 13, a HP vent 14, a HP by-pass valve 15, and other valves 26. The loop vents 11, the HP drains 13, and the HP vent 14 preferably provide a flow path to a condenser 22, as understood by those skilled in the art, which condenses the steam circulated or flowing thereto. The IP steam turbine 16 includes hood sprays 18, IP drains 19, an LP bypass valve 20, and a plurality of valves 21 (e.g., interceptor valve (IV), reheat stop valve (RV), induction control valve (ICV), and induction stop valve (ISV) positioned in fluid communication therewith. The hood sprays 18, IP drains 19, and LP bypass valve 20 are also in fluid communication with the condenser 22 as well. A heat recovery steam generator 25 is also positioned in fluid communication with the turbines 12, 16 for generating steam at the respective high, intermediate, and low pressures. Cooled steam can also be directed to flow through or circulate to a reheater 24 of the heat recovery steam generator 25 as illustrated.

Figure 4:
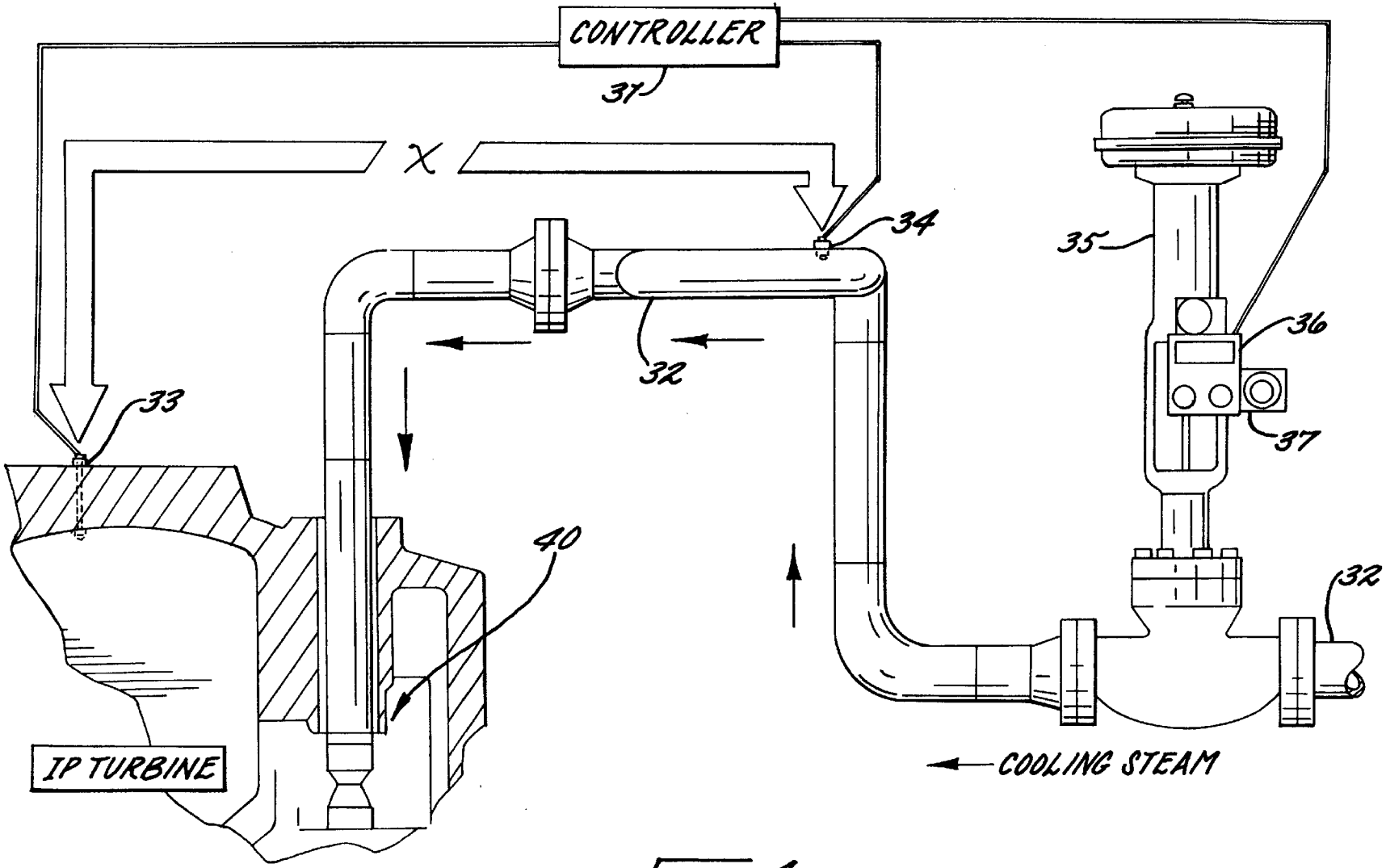
FIG. 4 is an enlarged side elevational view of portions of a steam cooling system for a balance piston according to the present invention.

The steam cooling system 30 preferably also includes a cooling steam conduit 32, e.g., piping, tubing, or line, having an inlet adjacent the first HP turbine 12 and an outlet adjacent the balance piston 40 for providing a steam cooling path therebetween. The system 30 also has steam pressure controlling means connected to the conduit 32 for controlling cooling steam pressure during cooling steam flow between the first HP turbine 12 and the second IP turbine 16. The steam pressure controlling means preferably includes a controller 31 positioned to control cooling steam pressure, a cooling steam control valve 35 connected to the conduit 32 and the controller 31, a first pressure sensor 33 in communication with the controller 31 and positioned adjacent the inlet 17 of the IP steam turbine 16 and downstream from the balance piston 40 for sensing inlet pressure to the IP turbine, e.g., preferably at the IP turbine blading as shown, and a second pressure sensor 34 positioned in communication with the controller 31 in the conduit 32 upstream from the first pressure sensor 33 and the balance piston 40 and downstream from the cooling steam control valve 35 for sensing conduit cooling steam pressure so that the cooling steam control valve 35 operationally opens and closes to maintain or regulate the cooling steam conduit pressure at a predetermined level X greater than the inlet pressure of the second IP steam turbine 16 (see FIG. 4).

In order to provide cooling to the IP rotor inlet area 17, the cooling steam system 30 is preferably used and will be operationally described herein. The cooling steam conduit 32 or line preferably obtains steam from two locations in the HP steam turbine 12, namely the HP exhaust and the HP balance piston leakoff as understood by those skilled in the art. The mixed cooling steam passes through the control valve 35 and into a hollow dowel pin in the ring, e.g., having seals as understood by those skilled in the art, upstream from the IP balance piston, e.g., at a six o'clock position. The cooling steam then flows to the rotor through an internal passage in the ring upstream from the IP balance piston providing cooling for the IP balance piston and first stage rotor area. The amount of HP balance piston leakoff steam of a HP balance piston (not shown), positioned upstream from the HP steam turbine adjacent the inlet of the HP steam turbine, that is used in this system 30 is preferably determined or controlled by the radial seal clearance in the HP balance piston as understood by those skilled in the art. The higher temperature gland leakage steam is mixed in the cooling steam conduit 32 with the cooler HP exhaust steam to produce a cooling steam supply, e.g., at approximately 770 degrees Fahrenheit.

During normal operation of the steam turbines 12, 16, the cooling steam control valve 35 is wide open. During period of operation when the interceptor valve 21 is regulating IP inlet flow (such as during startup and low load), however, the control valve 35 will modulate. In these cases the valve 35 will modulate in order to regulate the downstream cooling steam pressure so as not to create a thrust imbalance on the IP balance piston. The controller 31 controls the position of the control valve 35 based on the pressure ratio of the IP cylinder inlet pressure and the cooling steam line pressure measured downstream of the control valve 35. The controls are configured as to regulate the valve position of the cooling steam control valve 35 to maintain a predetermined level of cooling steam conduit pressure, e.g., equal to 110%, of the IP inlet pressure. This pressure ratio approximately matches the expected reheater pressure drop during full load operation. This ensures that during normal operation, the control valve 35 will be fully open.

During roll-up, the cooling steam control valve 35 is not opened until steam is admitted to the HP steam turbine 12 and the HP exhaust pressure is 10% higher than the IP inlet pressure. If either the IP inlet pressure or the cooling steam conduit pressure inputs to the controller 31 fail, the controller 31 will automatically close the cooling steam control valve 35. Under these conditions the operator will be alerted to the failure by the controller 31. The operator can then monitor closely the thrust bearing metal temperatures as well as the supervisor instrument rotor position reading for indications of excessive thrust bearing loading.

Figure 2:
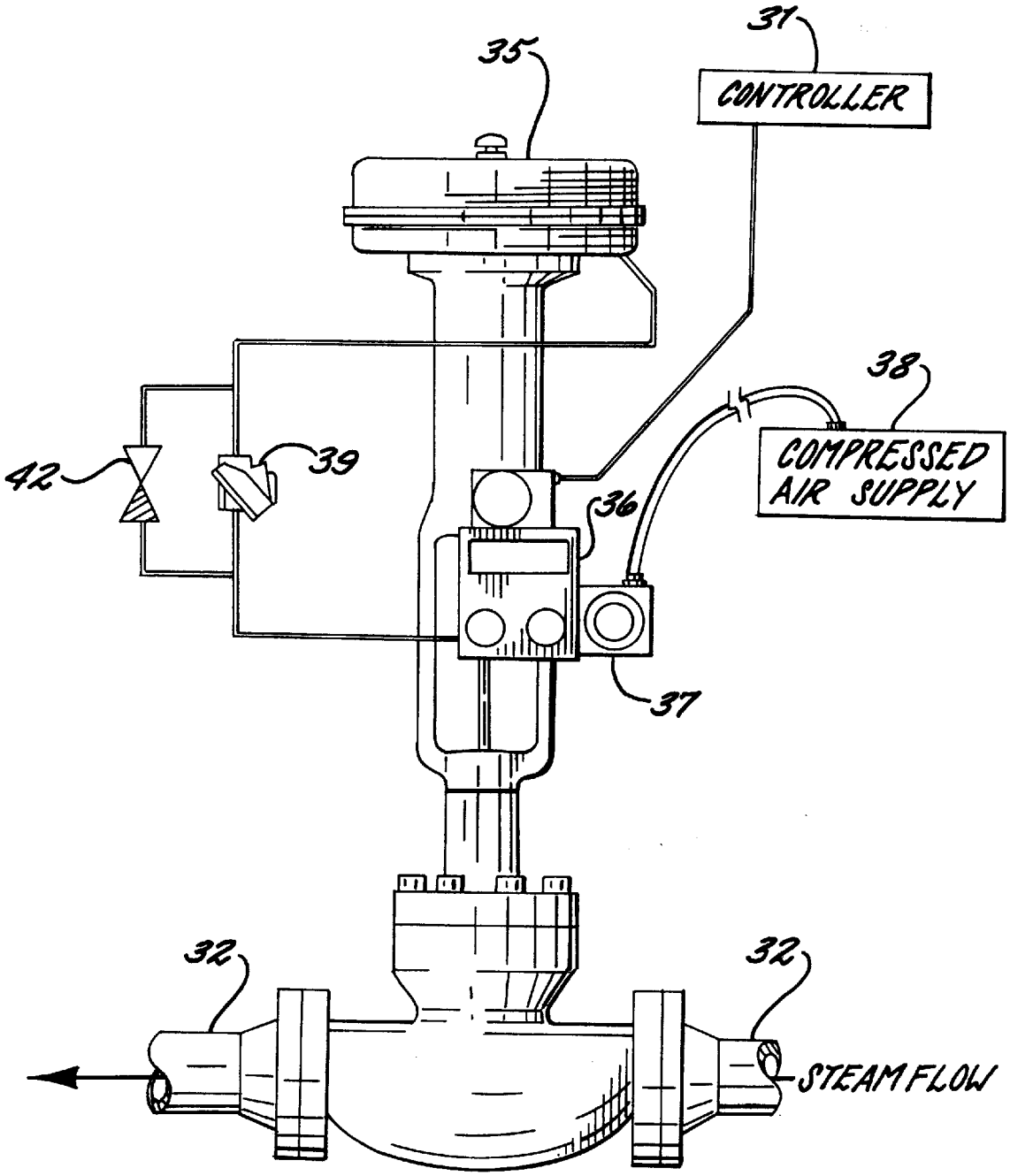
FIG. 2 is an enlarged front elevational view of a control valve of a steam cooling system for a balance piston according to the present invention.

As perhaps best illustrated in FIG. 2, the cooling steam control valve 35 is preferably a four-inch, 600 pound (lbs.), globe valve positioned in the steam cooling conduit 32 between the HP steam turbine 12 and the IP/LP steam turbine 16. The valve position is controlled using a current-to-pneumatic positioner 36 which regulates the conduit pressure in a pneumatic actuator 37, e.g., between 6 and 30 pounds per square inch (psi). An air or compressed air supply 38 is positioned to send air through a regulator prior to entering the positioner 36. The pneumatic actuator 37 is designed such that 6 psi closes the control valve 35 and 30 psi corresponds to a fully open position. The positioner 36 receives a 4–20 milliampere (ma) signal from the controller 31 which is designed for 4 ma being closed and 20 ma being open. Having the air and current signals calibrated in such a manner ensures that should either the controller 31 or the pneumatic control signal fail, the control valve 35 will close. It will be understood by those skilled in the art that the controller 31 can be either a separate controller or form a portion of a turbine control system which also controls the operation of the turbines in the system 10.

Closure of this control valve 35 can be critical because the cooling steam control valve 35 also protects the thrust bearing during a steam turbine trip. During a trip condition, the IP/LP steam turbine 16 can be rapidly evacuated to the condenser 22 while the HP steam turbine 12 might not evacuate as quickly depending primarily on the response time of the HP vent valve. A condition where the IP/LP steam turbine or cylinder 16 evacuates and the HP steam turbine or cylinder 12 does not can result in a large pressure difference applied to the IP balance piston thus thrusting the rotor. In order to limit the duration of this event, the cooling steam control valve 35 will be directed to rapidly close anytime flow is disrupted into the IP steam turbine 16 such as during a turbine trip or an overspeed protection control (OPC) action.

The cooling steam control valve 35 is preferably designed to close in one second during these events. To allow for this rapid closing time, a quick release valve 39 is provided to vent the air from the actuator to atmosphere (see FIG. 2). During a trip or OPC action, the controller 31 would rapidly set the demand to the steam cooling valve positioner 36 to a fully closed position.

The resulting sudden drop in the positioner outlet pressure activates the quick release valve 39. Thus, this action dumps the actuator pressure to atmosphere and rapidly closes the valve 35.

Under normal part load operation when the steam cooling control valve 35 is required to modulate, the demand signal to the positioner 36 is a slow-moving setpoint from the controller 31. The quick release valve 39 allows for normal flow of air into the actuator 37 for opening and maintaining a given valve position. For slow valve movement in the closed position, a bypass valve 42 on the cooling steam valve 35 allows air to flow out of the actuator 37 to the positioner 36 closing the valve 35 in a controlled manner. In order to ensure proper operation of the DEH output, the positioner 36, and the actuator 37, a limit switch 44 is preferably provided on the cooling steam control valve 35 to indicate if the valve 35 has gone closed when not required. Under these conditions the operator would follow the monitoring and contingency operations described above.

As illustrated in FIGS. 1–4, the present invention also includes a method of steam cooling a turbine system 10. The method preferably includes positioning a balance piston 40 adjacent the inlet 17 of an intermediate pressure (IP) steam turbine 12 and between the IP steam turbine 12 and a high pressure (HP) steam turbine 16, providing a steam cooling path between the IP and HP steam turbines 12, 16 and in communication with the balance piston 40, and controlling cooling steam pressure during cooling steam flow between the HP steam turbine 12 and the IP steam turbine 16 so that the cooling steam conduit pressure is operationally maintained at a predetermined level greater than the inlet pressure of the IP steam turbine 12.

The step of controlling cooling steam pressure preferably includes providing a cooling steam control valve 35 positioned in the steam cooling flow path, sensing a variance in pressure between the inlet 17 to the IP steam turbine 16 and pressure in the steam cooling flow path upstream from the balance piston 40, and opening or closing at least portions of the control valve 35 responsive to the sensed variance. The method can also advantageously include determining when the control valve 35 closes when not required. The control valve 35 can include a pneumatic actuator 37, and the method can further include rapidly releasing the actuator pressure to vent air from the actuator 37 to atmosphere.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

What is claimed is:

1. A steam cooling system comprising:

a first high pressure (HP) steam turbine having a straight through configuration;

a second intermediate pressure (IP) steam turbine having a straight through configuration positioned adjacent the first HP steam turbine;

a common heated steam conduit region positioned between the HP steam turbine and the IP turbine to supply steam substantially simultaneously to the IP steam turbine and the HP steam turbine;

a balance piston positioned adjacent the inlet of the second IP steam turbine and between the second IP steam turbine and the first HP steam turbine;

a cooling steam conduit having an inlet adjacent the first HP turbine and an outlet adjacent the balance piston for providing a steam cooling path therebetween; and steam pressure controlling means responsive to sensing differences in steam pressures and connected to the cooling steam conduit for controlling cooling steam pressure during cooling steam flow between the first HP turbine and the second IP turbine so that the cooling steam conduit pressure is operationally maintained at a predetermined level greater than the inlet pressure of the second IP turbine.

2. A cooling steam system as defined in claim 1, wherein said steam pressure controlling means includes a cooling steam controller positioned to control cooling steam pressure, a cooling steam control valve connected to the conduit and said controller, a first pressure sensor in communication with said controller and positioned adjacent the inlet of the IP turbine and downstream from the balance piston for sensing inlet to the IP turbine, and a second pressure sensor positioned in communication with said controller in the conduit upstream from the first pressure sensor and the balance piston and downstream from the cooling steam control valve for sensing conduit cooling steam pressure so that the cooling steam control valve operationally opens and closes to regulate the cooling steam conduit pressure at a predetermined level greater than the inlet pressure of the second IP turbine.

3. A steam cooling system as defined in claim 2, wherein the second IP turbine includes reaction blading.

4. A steam cooling system as defined in claim 2, wherein the predetermined level substantially equates to expected reheater pressure drop during a full load operation of the first and second steam turbines.

5. A steam cooling system as defined in claim 4, wherein the predetermined level comprises 110% of the inlet pressure of the second IP steam turbine.

6. A steam cooling system as defined in claim 2, wherein the cooling steam pressure controlling means further includes an air supply connected to the cooling steam control valve, and wherein the cooling steam control valve includes a pneumatic actuator connected to the air supply for pneumatically opening and closing the cooling steam control valve and a current-to-pneumatic positioner connected to the controller for receiving a predetermined current from the controller and regulating the air supplied from the air supply to the pneumatic actuator for responsively opening and closing the cooling steam control valve.

7. A steam cooling system as defined in claim 6, wherein the cooling steam control valve further includes a bypass needle valve positioned to allow air to flow out of the actuator to the positioner to enhance controlling of the opening and closing of the valve and a quick release valve positioned to vent air from the actuator to atmosphere.

8. A steam cooling system as defined in claim 1, wherein the conduit is positioned to receive steam from an exhaust outlet of the first HP steam turbine and from a balance piston leakoff outlet of the first HP steam turbine.

9. A steam cooling system comprising:

a balance piston positioned between a first steam turbine and a second steam turbine and adjacent an inlet of the second steam turbine;

a common heated steam conduit region positioned between the first steam turbine and the second steam turbine to supply steam substantially simultaneously to the first steam turbine and the second steam turbine;

a cooling steam conduit having an inlet adjacent the first turbine and an outlet adjacent the balance piston for providing a steam cooling path therebetween;

a cooling steam controller positioned to control cooling steam pressure within the conduit;

a cooling steam control valve connected to the cooling steam conduit and the controller;

a first pressure sensor in communication with the controller and positioned adjacent the inlet of the second steam turbine and downstream from the balance piston for sensing inlet steam pressure to the second steam turbine; and a second pressure sensor positioned in communication with the controller in the conduit upstream from the first pressure sensor and the balance piston and downstream from the cooling steam control valve for sensing conduit cooling steam pressure so that the cooling steam control valve operationally opens and closes to regulate the cooling steam conduit pressure at a predetermined level greater than the inlet pressure of the second steam turbine.

10. A steam cooling system as defined in claim 9, wherein the second steam turbine includes reaction blading.

11. A steam cooling system as defined in claim 9, wherein the predetermined level substantially equates to expected reheater pressure drop during a full load operation of the first and second steam turbines.

12. A steam cooling system as defined in claim 11, wherein the predetermined level comprises 110% of the inlet pressure of the second steam turbine.

13. A steam cooling system as defined in claim 9, further comprising an air supply connected to the cooling steam control valve, and wherein the cooling steam control valve includes a pneumatic actuator connected to the air supply for pneumatically opening and closing the cooling steam control valve and a current-to-pneumatic positioner connected to the controller for receiving a predetermined current from the controller and regulating the air supplied from the air supply to the pneumatic actuator for responsively opening and closing the cooling steam control valve.

14. A steam cooling system as defined in claim 13, wherein the cooling steam control valve further includes a bypass needle valve positioned to allow air to flow out of the actuator to the positioner to enhance controlling of the opening and closing of the valve and a quick release valve positioned to vent air from the actuator to atmosphere.

15. A steam cooling system as defined in claim 9, wherein the conduit is positioned to receive steam from an exhaust outlet of the first HP steam turbine and from a balance piston leakoff outlet of the first HP steam turbine.

16. A steam cooling controlling apparatus for controlling cooling steam pressure during cooling steam flow between at least a pair of steam turbines, the apparatus comprising:

a cooling steam controller positioned to control cooling steam pressure, the controller being responsive to sensing differences in steam pressures;

a cooling steam control valve positioned to be connected to conduit in fluid communication with at least a pair of steam turbines and to said controller;

a first pressure sensor in communication with said controller and positioned adjacent an inlet of at least one of the pair of steam turbines for sensing inlet steam pressure to the at least one of the pair of steam turbines; and a second pressure sensor positioned in communication with said controller in the conduit upstream from the first pressure sensor and downstream from the cooling steam control valve for sensing conduit cooling steam pressure so that the cooling steam control valve operationally opens and closes to maintain the cooling steam conduit pressure at a predetermined level greater than the inlet pressure of a downstream steam turbine of the at least a pair of steam turbines.

17. An apparatus as defined in claim 16, wherein at least one of the pair of steam turbines includes a balance piston positioned upstream from the inlet of the downstream steam turbine, upstream from the first pressure sensor, downstream from the second pressure sensor, and downstream from an upstream steam turbine of the at least a pair of steam turbines, the balance piston also being in fluid communication with the conduit and the pair of steam turbines.

18. An apparatus as defined in claim 17, wherein the predetermined level substantially equates to expected reheater pressure drop during a full load operation of the at least a pair of steam turbines.

19. An apparatus as defined in claim 18, wherein the predetermined level comprises 110% of the inlet pressure of the downstream steam turbine.

20. An apparatus as defined in claim 17, further comprising an air supply connected to the cooling steam control valve, and wherein the cooling steam control valve includes a pneumatic actuator connected to the air supply for pneumatically opening and closing the cooling steam control valve and a current-to-pneumatic positioner connected to the controller for receiving a predetermined current from the controller and regulating the air supplied from the air supply to the pneumatic actuator for responsively opening and closing the cooling steam control valve.

21. An apparatus as defined in claim 20, wherein the cooling steam control valve further includes a bypass needle valve positioned to allow air to flow out of the actuator to the positioner to enhance controlling of the opening and closing of the valve and a quick release valve positioned to vent air from the actuator to atmosphere.

22. A method of steam cooling a turbine system, the method comprising steps of:

positioning a balance piston adjacent the inlet of an intermediate pressure (IP) steam turbine and between inlets of both the IP steam turbine and a high pressure (HP) steam turbine;

providing a steam cooling path between the IP and HP steam turbines and in communication with the balance piston; and controlling cooling steam pressure during cooling steam flow between the HP turbine and the IP turbine so that the cooling steam conduit pressure is operationally maintained at a predetermined level greater than the inlet pressure of the IP turbine.

23. A method as defined in claim 22, wherein the step of controlling cooling steam pressure includes providing a cooling steam control valve positioned in the steam cooling flow path, sensing a variance in pressure between the inlet to the IP steam turbine and pressure in the steam cooling flow path upstream from the balance piston, and opening or closing at least portions of the control valve responsive to the sensed variance.

24. A method as defined in claim 23, further comprising the step of determining when the control valve closes when not required.

25. A method as defined in claim 23, wherein the control valve includes a pneumatic actuator, and the method further comprising rapidly releasing the actuator pressure to vent air from the actuator to atmosphere.

* * * * *